US007918671B2

(12) United States Patent
Chen et al.

(10) Patent No.: US 7,918,671 B2
(45) Date of Patent: Apr. 5, 2011

(54) MOUNTING STRUCTURE WITH SPRINGS BIASING TOWARDS A LATCHING EDGE

(75) Inventors: Chao Chen, Waterloo (CA); John A. Holmes, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

(21) Appl. No.: 10/889,075

(22) Filed: Jul. 13, 2004

(65) Prior Publication Data

US 2006/0014405 A1 Jan. 19, 2006

(51) Int. Cl.
*H01R 12/00* (2006.01)

(52) U.S. Cl. ..... 439/70

(58) Field of Classification Search ..... 439/70, 439/71, 72, 73, 74, 66, 83
See application file for complete search history.

(56) References Cited

U.S. PATENT DOCUMENTS

| | | | | |
|---|---|---|---|---|
| 4,089,575 | A | 5/1978 | Grabbe | |
| 4,341,433 | A * | 7/1982 | Cherian et al. | 439/525 |
| 4,506,938 | A | 3/1985 | Madden | |
| 4,652,973 | A | 3/1987 | Baker et al. | |
| 4,718,855 | A | 1/1988 | Billman et al. | |
| 4,936,784 | A | 6/1990 | Saito | |
| 4,954,088 | A * | 9/1990 | Fujizaki et al. | 439/73 |
| 6,190,210 | B1 * | 2/2001 | Belopolsky et al. | 439/676 |
| 6,292,003 | B1 * | 9/2001 | Fredrickson et al. | 324/755 |
| 6,340,315 | B1 * | 1/2002 | Chang | 439/660 |
| 6,435,882 | B1 * | 8/2002 | Pitou | 439/70 |
| 6,533,595 | B2 * | 3/2003 | Yamada | 439/266 |
| 6,559,665 | B1 * | 5/2003 | Barabi | 324/755 |
| 6,607,396 | B1 * | 8/2003 | Ito | 439/331 |
| 6,648,654 | B1 * | 11/2003 | Akram et al. | 439/70 |
| 6,731,516 | B1 * | 5/2004 | Ma | 361/802 |
| 6,743,043 | B2 * | 6/2004 | Yamada | 439/482 |
| 6,827,588 | B1 * | 12/2004 | Huang et al. | 439/74 |
| 6,862,804 | B2 * | 3/2005 | Nishio et al. | 29/840 |
| 6,939,172 | B2 * | 9/2005 | Lu | 439/607 |
| 7,029,288 | B2 * | 4/2006 | Li | 439/66 |
| 7,128,592 | B2 * | 10/2006 | Li | 439/289 |
| 7,226,297 | B2 * | 6/2007 | Li | 439/71 |
| 2003/0218873 | A1 * | 11/2003 | Eromaki et al. | 361/816 |
| 2004/0023527 | A1 | 2/2004 | Nichio et al. | |
| 2004/0157652 | A1 | 8/2004 | Yamazaki | |
| 2005/0153600 | A1 * | 7/2005 | Lu | 439/607 |
| 2005/0215118 | A1 * | 9/2005 | Asai et al. | 439/607 |

FOREIGN PATENT DOCUMENTS

EP 0294111 A2 12/1988

(Continued)

*Primary Examiner* — Chandrika Prasad
(74) *Attorney, Agent, or Firm* — Novak Druce + Quigg LLP

(57) ABSTRACT

A digital camera is mounted to a circuit-board in a cellphone. The camera is mounted in a plastic main-body, and is supported therein on a bed of springs, which provides a stable resilient mechanical support. The springs double as connector-strips, being electrically-active connector-strips for conducting electrical signals and services between the component and a circuit-board. The connector-strips are solidly attached to the circuit-board, by being soldered thereto. The main-body is not attached directly to the circuit-board, but rather is attached directly to the connector-strips. These measures ensure that the camera is mechanically isolated from the circuit-board whereby, if the cellphone is dropped or knocked, the inertia of the camera does not damage the circuit board.

2 Claims, 5 Drawing Sheets

FOREIGN PATENT DOCUMENTS

| | | |
|---|---|---|
| EP | 1387607 | 2/2004 |
| EP | 1387607 A1 | 2/2004 |
| JP | 2001188155 A | 7/2001 |
| JP | 2004180223 | 6/2004 |

* cited by examiner

MOUNTING STRUCTURE WITH SPRINGS BIASING TOWARDS A LATCHING EDGE

This specification relates to a manner of mounting cameras and other items on a circuit board, particularly in a product like a cellphone, where space is at a tight premium, and where the product must be capable of standing up to accidental knocks, such as might occur if the product is dropped.

Traditionally, there have been basically two approaches to connecting a camera to the circuit board. First, the camera unit may be fastened solidly to the circuit board. The problem with this is that the camera is a rather heavy item (the camera itself can weigh up to three grams, and the plinth structure onto which the camera is physically integrated adds a further gram or two to the total mass), and when the camera is jarred or dropped the large inertia and mass of the camera unit throws a momentary strain and stress onto whatever is holding the camera unit onto the board. If this is the electrical wires or connections, such abusive mechanical stresses can lead to premature failure. Thus, mounting the camera unit solidly to the circuit board is contra-indicated. Besides, often it is not permissible to solder the camera directly to the board, because the heat would damage the camera.

The hitherto more favoured manner of connecting a camera to a circuit board has been to mount the camera mechanically separately from the circuit board. The camera may be mounted solidly into e.g the frame of the cellphone, or may be allowed a small degree of float or movement relative to the frame of the cellphone. The electrical connections to the circuit board have then been made by means of a flexible ribbon.

Flexible ribbon connectors are notoriously expensive, especially when engineered to be reliable electrically on a mass production basis. However, ribbons do have the benefit that none of the electrical connections have to bear the mechanical shocks and attendant stresses and strains that arise due to the inertia and mass of the camera when the cellphone is jolted or jarred, and the ribbon arrangement has generally been favoured for that reason. As mentioned, designers have not dared to mount the (heavy) camera directly solidly to the circuit board, for fear of the effect of jars and jolts.

Preferably, the component (e.g a camera) is mounted on or in a plastic main-body, and is supported therein on a bed of springs, which provides a stable resilient mechanical support. Preferably, the springs double as connector-strips, being electrically-active connector-strips for conducting electrical signals and services between the component and a circuit-board. Preferably, the connector-strips are solidly attached to the circuit-board, as by being soldered thereto. Preferably, the main-body is not attached directly to the circuit-board, but rather is attached directly to the connector-strips.

DETAILED DESCRIPTION OF DRAWINGS

By way of further explanation, examples will now be described with reference to the accompanying drawings, in which.

Figure 1:
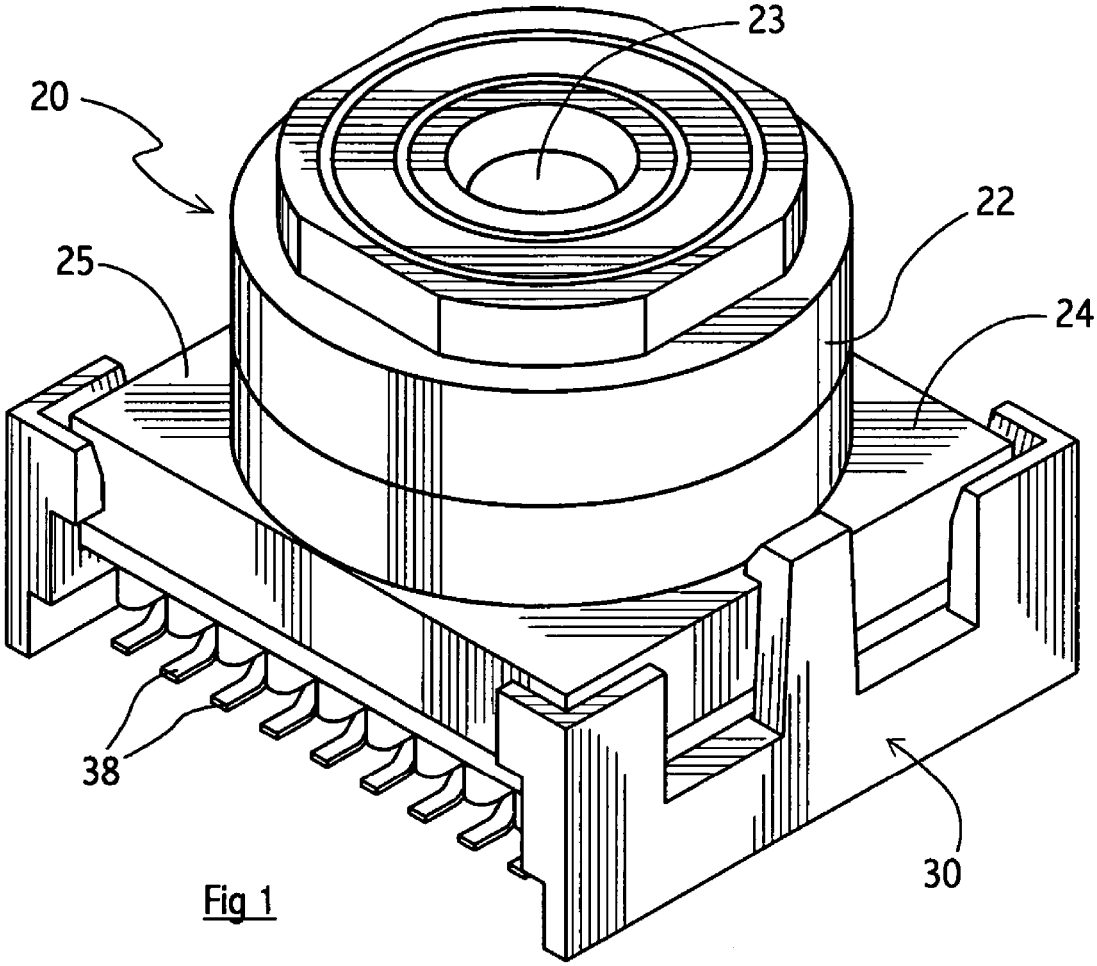
FIG. 1 is a pictorial view showing a camera mounted in a mounting-structure, suitable for fixing to a circuit board in a cellphone.
Figure 2:
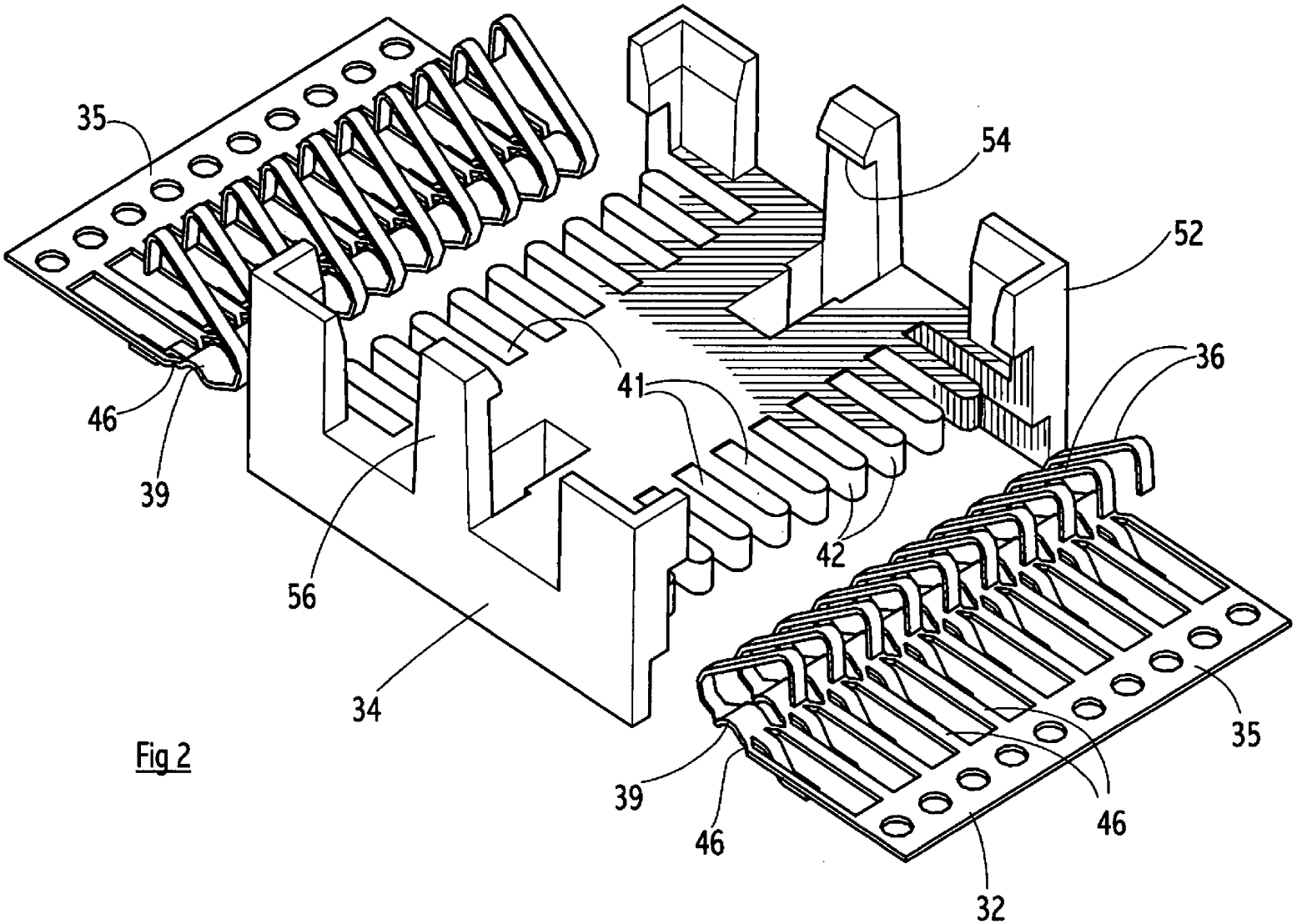
FIG. 2 is a view of the components of the mounting-structure, prior to assembly.

The apparatuses shown in the accompanying drawings and described below are examples. It should be noted that the scope of the patent protection sought is defined by the accompanying claims, and not necessarily by specific features of exemplary embodiments.

The camera-unit 20 is itself conventional. The designer can select from numerous proprietary standard sizes and shapes. The camera-unit 20 has a plastic housing 22 protecting the lens 23. The housing 22 includes a plinth 24, having an overface 25 and an underface 26. The camera-unit 20 is provided with a number—in this case, twenty—of contact-patches 27, set in the underface 26 of the camera plinth.

The mounting-structure 30 is made from three components, being a left connector-rack, a right connector-rack 32, and a main-body 34. The main-body 34 is a plastic moulding, and the connector-racks 32 are brass stampings.

The connector-racks 32 are made from respective single pieces of metal. The single piece remains intact while the rack is being assembled into the main-body 34. After the racks have been assembled in position in the main-body, respective link-bars 35 of the racks are detached therefrom. The removal of the link-bars leaves respective series of separate connector-strips 36 now attached individually into the main-body. Once the link-bars are removed, the now-separate connector-strips 36 are separate mechanically and electrically.

Each connector-strip 36 has an upstanding springy-arm 37, a contact-platform 38, a platform-arm 39, and an attachment-portion 40.

Figure 5:
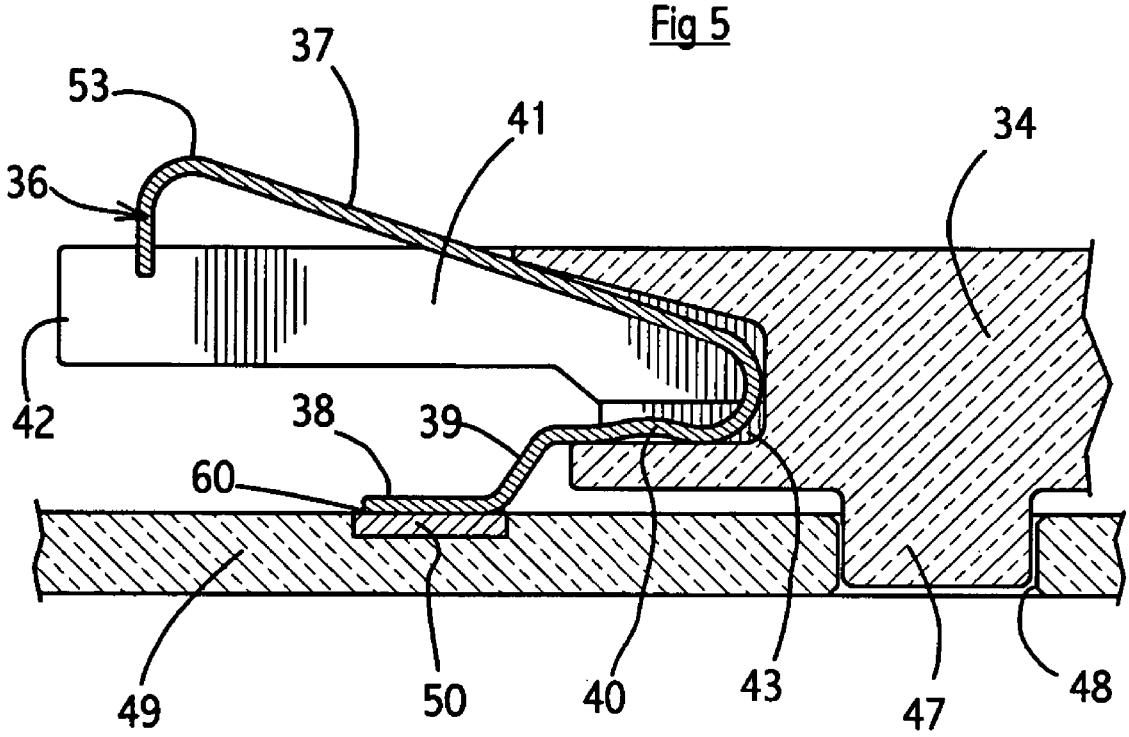
FIG. 5 is cross-sectional elevation showing a detail of the mounting-structure.

As shown in the drawings, the main-body 34 is moulded with a left and a right series of slots 41, separated by peninsulas 42. Each slot 41 is a little wider than the width of the springy-arm 37, so the springy-arm can move freely up/down within the slot. Below the slot 41 is an attachment-pocket 43 (FIG. 5), which is of a width that is a little tighter than the width of the attachment-portion 40. The attachment-pocket 43 is wider than the slot 41, commensurate with the attachment-portion 40 being wider than the springy-arm 37, as may be understood from the drawings.

The width-interference between the attachment-portion 40 of the connector-strip 36 and the attachment-pocket 43 in the main-body 34 is what holds the connector-strip firmly in place in the main-body moulding 34. There are no rivets or other fasteners, as such, holding the twenty connector-strips in place.

During manufacturing assembly, the connector-rack 32 is mounted in a fixture in the (automatic) assembly machine. The rack 32 is aligned such that the springy-arms 37 engage in the slots 41. The rack travels deeper into the slots, until the sides of the attachment-portions 41 encounter the sides of the attachment-pockets 43, and become jammed therein. The rack is pushed fully home, such that the attachment-portions lie deep and tight within the attachment-pockets. At this point, the link-bars 35 are still in place, coupling the several connector-strips 36 together. However, now that the attachment-portions 40 are held securely, each tightly gripped within its respective attachment-pocket 43, the link-bars 35 can now be removed.

The metal stamping from which the connector-rack 32 is made is formed with notches 45. That is to say, every one of the eleven arms 46 of the link-bar 35 is notched. Thus, once the rack 32 has been pressed into place, it is now a relatively simple matter to break the link-bar 35 away from the ten connector-strips 36. Of course, the notches 46 must be made properly—neither so deep that the link-bars 35 would break away during assembly/insertion of the rack; nor so shallow that considerable force would be needed to break the link-bar off, which might lead to the connector-strips 36 being dislodged by the act of breaking off the link-bar 35. It is recognised that an adequate margin between these two extremes can be engineered. The designer may prefer to have the link-bars broken off after soldering, instead of before soldering as described.

Figure 3:
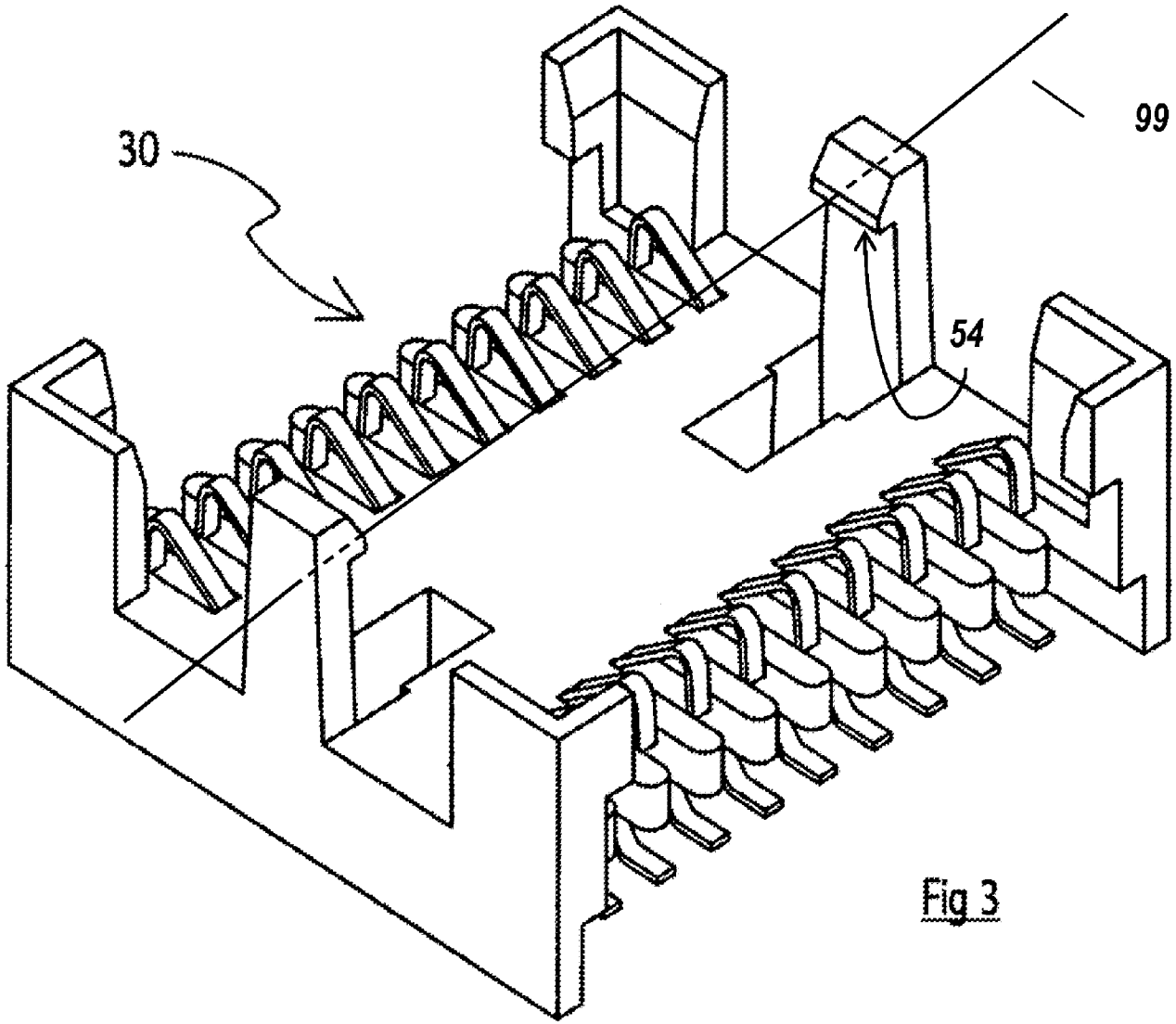
FIG. 3 is the same view as FIG. 2, but shows the components after assembly.

With the two link-bars 35 removed, and the twenty now-separated connector-strips 36 in place, the mounting-structure is as shown in FIG. 3, and is ready to be mounted on the circuit board of the cellphone. Two dowels 47 protrude from the underface 26 of the main-body 34, and these engage with corresponding dowel-holes 48 in the circuit-board 49.

Figure 4:
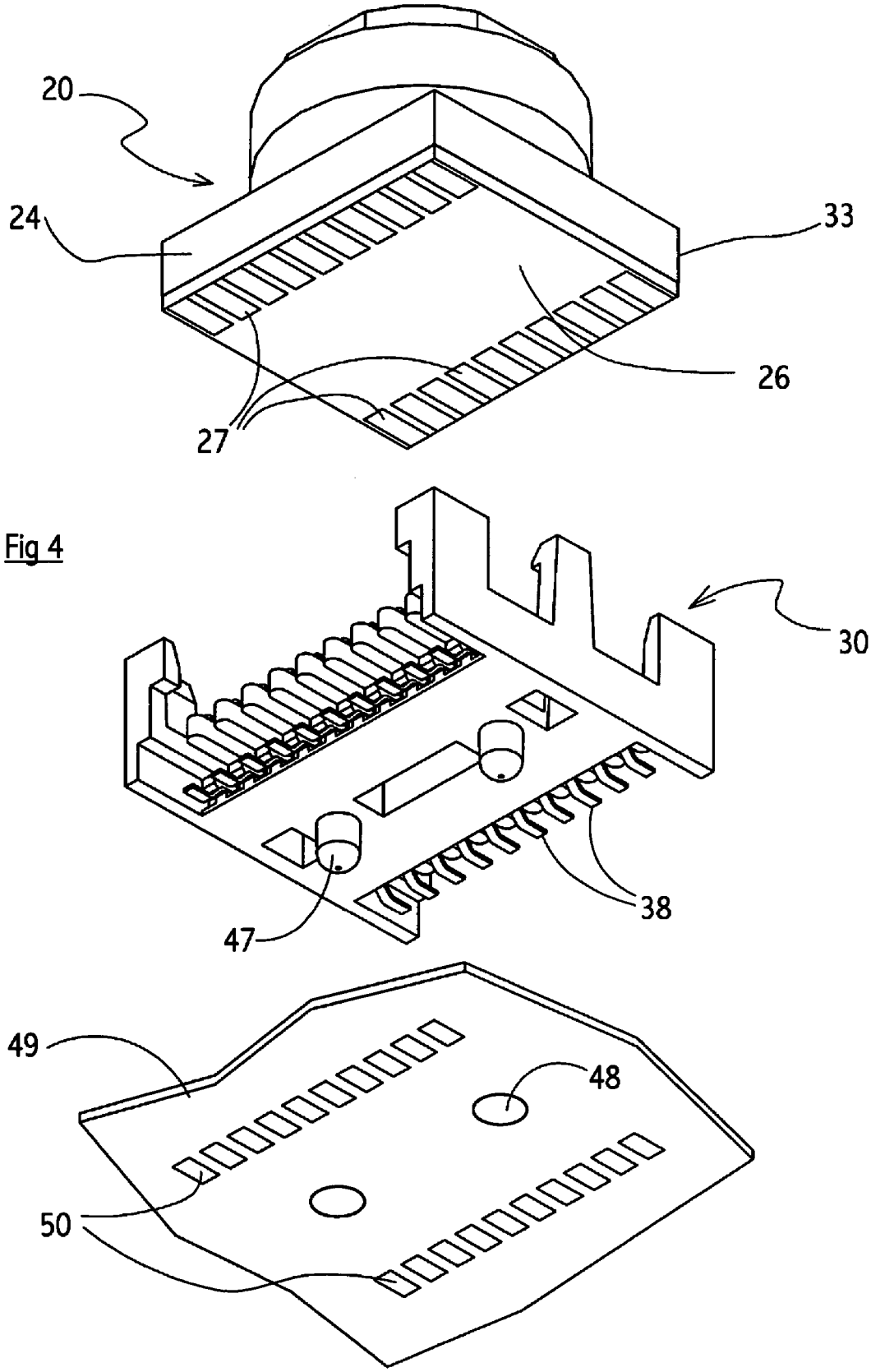
FIG. 4 is a view from underneath, showing a camera about to be lowered into position in the mounting-structure.

The designer arranges that, when the dowels 47 are in the dowel-holes 48, the contact-platforms 38 are aligned with the electrical contact-pads 50 on the circuit-board 49 (FIG. 4). The contact-platforms 38 are then flow-soldered to the contact-pads 50. (Note that FIG. 4 is an illustrative diagram; of course the contact-pads 50 are on top of, not underneath, the circuit-board 49.)

It is an easy matter for the designer to be sure that the connector-strips 36 are all pushed to the same position (i.e the same height and depth) within the main-body 34. Of course, inevitably there will be some slight mismatches, whereby not all twenty of the contact-platforms 38 will be in actual touching contact with their respective contact-pads 50 on the circuit-board 49. However, it is recognised that the described manner of attaching the connector-strips 36 into the main-body 34, despite using no fasteners, leaves every one of the contact-platforms 38 so nearly touching its respective contact-pad 50 that solder will easily fill such small gaps as may actually be present.

Once the contact-platforms 38 have been soldered to the contact-pads 50, the mounting-structure 30 itself is now (to an extent as will be explained in more detail below) mechanically fast with respect to the circuit-board 49. The soldered joints 60 between the contact-pads 50 and the contact-platforms 38, once properly made, remain rigid and mechanically immovable.

It will be understood that the main-body plastic moulding 34 of the mounting-structure 30 is not itself attached directly to the circuit-board 49, but rather that it is the connecter-strips 36 (in fact, the contact-platforms 38 of the connector-strips) that are attached solidly and directly to the circuit-board 49. The main-body 34 itself is not fastened otherwise than by being fast with the attachment-portions 40 of the individual connector-strips 36.

With the mounting-structure 30 attached to the circuit-board 49, now the camera-unit 20 can be assembled to the mounting-structure.

The main-body 34 is formed with corner-pieces 52, which are dimensioned to receive the corners 33 of the camera plinth 24. Guided between the corner-pieces 52, the camera-unit 20 is constrained against lateral and rotational movement relative to the mounting-structure. As the camera-unit 20 is pressed down (against the resilience of the springy-arms 37) between the corner-pieces 52, the twenty contact-patches 27 in the underface 26 of the plinth 24 make contact with the twenty contact-tips 53 on the corresponding springy-arms 37. The designer has seen to it that the corner-pieces 52 guide the plinth 24 accurately enough to ensure that the contact-patches 27 remain in alignment with the contact-tips 53. The springy-arms 37 are springy enough for the designer to be sure also that each contact-patch 27 makes good electrical contact with its respective contact-tip 53.

The camera-unit 20 is pressed down until latch-ledges 54 on the retaining-arms 56 snap over the plinth 24, engaging the overface 25 thereof. Now (FIG. 1), the camera-unit 20 is held securely against dislodgement in the mounting-structure 30. It can be released, but only if the retaining-arms 56 are deliberately bent back, and the designer can easily ensure this will not happen accidentally.

It will be understood that the described manner of mounting the camera on the circuit-board makes it relatively easy to ensure that electrical connections between the camera and the circuit-board remain true throughout the service life of the cellphone. The springiness of the springy-arms 37 keeps the contact-tips 53 of the springy-arms in engagement with the contact-patches 27 in the underface 26 of the camera-unit 20, even though the camera-unit might be permitted to move (slightly) relative to the mounting-structure.

Of course, failures are always possible, but it is considered that the likelihood of an electrical failure between the camera-unit 20 and the circuit-board 49 is much reduced when compared e.g with mounting a camera-unit solidly on a circuit-board, and even when compared with connecting a camera-unit to a circuit-board by means of a ribbon connector. It should be noted that the contact-patch 27 on the camera-unit 20 directly touches the piece of metal (i.e the connector-strip 36) that is itself directly soldered to the circuit board. There are no intermediate connectors or connector-components.

Again as to the reduced likelihood of an electrical break, it should be noted that, for each electrical path, there is only one non-soldered contact, i.e the contact between the contact-tip 53 and the contact-patch 27. By contrast, ribbon connectors are often not soldered, but are mechanically crimped; soldering the contact-platforms 38 to the contact-pads 50 is, by comparison, very tolerant of slight mismatching during manufacturing assembly.

Where electrical contacts are made by two metal surfaces being spring-loaded together, generally it does no harm if the metal surfaces can move slightly mechanically—which is what happens in the depicted structure when the components are impacted. The movement can be beneficial in that it scrapes the surfaces, and keeps the contacts clean. By contrast, the contacts in ribbon connectors never move at all due to jolts and knocks, and can deteriorate.

As mentioned, if the camera were soldered solidly to the circuit board, the camera is heavy enough, and dense enough, i.e the camera has enough mass and inertia, that knocks and shocks experienced by the cellphone might cause cracks to start in the soldered joints 60, and perhaps lead to a break in electrical continuity.

In the mounting system as described herein, the designer might have arranged for the spring forces produced by the springy-arms 37 to be large enough to hold the camera-unit 20 firmly against the latch-ledges 54, even if the camera-unit is jarred violently, e.g if the cellphone is dropped. However, preferably the designer should arrange for the camera-unit 20 to be free to undergo actual movement, e.g to undergo (small) bounce and rebound movements, relative to the mounting-structure 30, as a result of mechanical shocks. The resilience of the springy-arms 37 of the connector-strips 36 ensures that, despite such movement of the camera-unit, all the contact-tips 53 will remain in mechanical and electrical contact at all times with the contact-patches 27. At the same time, the resilience of the springy-arms absorbs the physical movement of the camera-unit 20.

Consider a heavy knock or jar to the cellphone, in such direction as to cause the camera-unit 20 to move bodily downwards in FIG. 1. That is to say, the shock is great enough to cause the overface 25 of the heavy camera-unit 20 to break free momentarily from one, or both, of the latch-ledges 54. This movement has no electrical penalty, in that the movement does not cause the contact-patches 27 to break free from the contact-tips 53. And immediately after that downwards movement, the camera-unit 20 will settle back, and will once again lie with the overface 25 pressed upwards against the latch-ledges 54, under the urging of the springy-arms 37 of the connector-strips 36.

Similarly, for other shock-induced modes of movement, including tipping, of the camera-unit 20, the springy-arms 37 can be expected to absorb at least most of the shock; that is to say, it can be expected that very little of the shock emanating from the camera unit will be transmitted to the soldered joints 60.

It can be regarded that the camera-unit is supported on a bed of springs. If the designer sets the spring forces to be light enough to allow the camera-unit 20 to move at all, the as-illustrated arrangement of the springs will permit the camera-unit to move in a number of modes. The camera-unit is guided for up/down movement by the engagement of the corner-pieces 52 of the main-body 34 (the mounting-guides) with the corners 33 of the camera-unit (the component-guides.) Regarding linear or bodily movement of the camera relative to the mounting-structure: the guides 33,52 constrain the camera against lateral movement in the back/front and left/right modes, but the guides 33,52 do not constrain against movement of the camera in the up/down mode. Regarding rotational movement of the camera with respect to the up/down axis: the guides 33,52 constrain the camera against rotational movement in the yaw-mode, but the guides 33,52 do not constrain against tipping movements in the pitch-mode and/or the roll-mode.

(It should be understood that the above-mentioned bounce/rebound movements, if they take place at all, are of tiny magnitude. However, even such tiny permitted movements can be very effective in mechanically isolating the soldered joints 60 from jolts and shocks emanating from the camera.)

The retaining-arms 56 and latch-ledges 54 are not very rigid structures. It might happen that a jolt on the cellphone acts in such a direction as to cause the camera-unit to impact heavily, for a moment, against the latch-ledges. In that case, the shock will not now be absorbed by the bed of springs; however, the shock in that case passes through the latch-ledges, through the retaining-arms, through the main-body 34, through the attachment-portions 40, and through the platform-arms 39, before it can reach the soldered joints and the circuit board. It should be regarded as most unlikely that a shock load arising from the inertia of the camera could be transmitted through all these elements to the circuit-board 49 with enough retained energy to crack the soldered joints or otherwise damage the circuit-board.

With most magnitudes and directions of jolts and knocks, it can be expected that, if the camera moves at all, the movement of the camera is absorbed by the bed of springs.

Only the contact-platforms 38 of the connector-strips 36 are rigid and solid with respect to the circuit-board 49. The camera-unit 20 is not rigid and solid with respect to the main-body 34, and the main-body is not rigid and solid with respect to the connector-strips. This mechanical isolation of the camera means the as-depicted mounting-structure can be expected to give a long life expectancy, both mechanically and electrically, to the mounting of a camera in a cellphone. At the same time, the depicted arrangement is simple and inexpensive to manufacture, is suitable for automated production and assembly, permits ready replacement of spare parts, and does so in a cost-effective and reliable manner.

It is preferred that the abutment support provided for the overface 25 of the camera-unit 20 by the latch-ledges 54 be what may be regarded as semi-solid (or as semi-resilient) with respect to the circuit-board 49. By comparison, the contact-platforms 38, upon being soldered to the contact-pads 50, are supported in a completely-solid manner with respect to the circuit-board; similarly, by comparison, the contact-patches 27 are supported in a completely-resilient manner with respect to the circuit-board. The latch-ledges 54 define a position-defining abutment, i.e an abutment that sets and defines the position of the camera; and that position-defining abutment is semi-solid.

The latch-ledges provide semi-solid support to the overface 25 in the following sense: (a) the latch-ledges 54 (and the retaining-arms 56 on which they are carried) are solid enough to pre-define the position of the assembled camera with adequate accuracy to ensure correct functioning of the camera; and yet (b) the latch-ledges 54 (and the retaining-arms 56 on which they are carried) are resilient enough, with respect to the circuit-board, to ensure that any shocks caused by the camera impacting against the latch-ledges, when transmitted through to the circuit-board, are so attenuated and dissipated by that transmission through the intervening components and structures as to be unable to damage the circuit-board or the soldered joints.

To avoid transmitting shocks from the camera to the circuit-board through the latch-ledges the latch-ledges preferably should be semi-solid, for the above reasons; to this end, the latch-ledges should be of small area, e.g preferably less than two percent of the area of the underface 26 of the camera-unit 24; also, the retaining-arms 56 on which the latch-ledges are carried should be flexible—as they are in that the retaining-arms are able to bend in order for the latch-ledges to snap over the overface 25. If the latch-ledge area were larger, and/or if the retaining-arms were inflexible, the danger might arise that the heavy camera would now be held too solidly with respect to the latch-ledges, and thus with respect to the mounting-structure, whereby too high a proportion of the impact energy arising from the mass of the camera might possibly be transmitted to the circuit-board. A large latch-ledge area would make the abutment too solid, i.e would constitute a solid abutment; rather, preferably, as mentioned, the springs should hold the camera against a semi-solid abutment—being an abutment, again, that is solid enough to serve as an accurate positioning abutment, but which at the same time has some "give" with respect to the circuit board.

It should be understood that the latch-ledge 54 area being no more than two percent of the underface 26 is only appropriate, as a way of defining the semi-solidness of the position-defining abutment, when the latch-ledge area and the underface are as clearly defined as they are in the depicted structure. In some other structures, that ratio is not defined well enough to be meaningful. Again, it is emphasised that the designer should arrange for the bed of springs to load the camera unit against a position-defining abutment that is semi-solid: not a completely-solid abutment, because that would enable an impact emanating from the heavy camera to reach the circuit board; nor yet a completely-resilient abutment, because that could not be relied on to position the camera accurately enough for proper functioning.

Depending on the particular layout of the mounting-structure, it might be that the important aspect of the semi-solidness of the latch-ledges is that there are two of them, and that they define a pivot axis. Thus, as will be understood from the drawings, the camera can easily tilt about a pivot-axis 99 defined by a line joining the two latch-ledges 54; therefore, one of the modes of movement available to the camera, when responding to an impact tending to move the camera upwards in FIG. 1, is that the camera can tilt, to left or right, rather than move bodily upwards, with respect to the latch-ledges. Thus, the pivot axis defines another degree of freedom in which the camera can move against the springs in response to an imposed shock. Only in the case of an impact directed vertically straight up would there be a chance of the full shock of the impact being transmitted through the latch-ledges to the circuit board.

Thus, the latch-ledges 54 define a pivot axis; the bed of springs is, in effect, divided into two beds, which together urge the camera to a mid-position, i.e to a position in which the aggregate force of the springs on one side is balanced by the aggregate on the other side. Thus, abutting the camera against just two small spaced latch-ledges is important in making the position-defining abutment semi-solid. If there were three, or more, latch-ledges, now the number of degrees of freedom of movement of the camera would be reduced, and the designer would find it that much more difficult to make sure (almost) all impacts emanating from the heavy camera could not reach the circuit-board.

Designers often provide a ring or collar of sponge/foam or the like, around the lens of the camera, i.e around the aperture in the cellphone casing through which the camera takes exposures. This foam acts as a seal, to keep dirt and moisture from penetrating. But it also has some slight shock-absorbing quality. However, the forces exerted on the camera by the foam are not enough to prevent the camera moving in the modes as described in response to shocks. Rather, the foam serves as a friction damper, to prevent the camera from rebounding and bouncing; i.e to enable the camera to settle back quietly against the latch-ledges after a shock-induced movement. The resilience of the foam acts in the direction to press the camera unit down towards the circuit board; therefore, the forces exerted by the foam must be light enough such that the camera does not break contact with the latch-ledges 54, except under a heavy impact.

Other arrangements for supporting a camera on a bed of springs may be considered. It is not essential that the number of springy-arms be twenty, nor that the springs be arranged in two well-spaced symmetrical rows. However, the number of springs should not be less than four; less than that, and the as-described notion of supporting the camera on a bed of springs becomes untenable.

However many springs are provided, it is important that they be arranged to form a stable bed for the component. Thus, where the component is a square camera, the bed of springs should extend to, or almost to, the four corners of the square. Concentrating the springs all in one central (or off-central) location would not do, because then the camera might be prone to tipping over.

It is preferred that the camera-unit be guided loosely in constraining guides with respect to the main-body—as the corners 33 are constrained by the corner-pieces 52, and that the bed of springs urges the camera-unit against a semi-solid abutment—like the latch-ledges 54. The camera-unit does have to be positioned in a predetermined location and orientation fairly accurately, and if the camera were mounted resiliently (i.e on springs) all around, it would be difficult to ensure proper alignment.

It is not essential that every one of the springs serve also as an electrical conductor. Where the component being mounted requires only e.g two conductors, the designer might elect to provide four or more springs, but the extra springs would not be electrically active. In many cases this would not be economical, and the preference is that every spring should be an electrically-active conductor. In the case of a camera, typically twenty separate connections to the circuit-board are required; each one includes a springy-arm, which conveniently provides a very satisfactory stable resilient bed for the camera.

It is preferred that the springs urge the component all in the same direction, against a fixed stop (e.g as against the latch-ledges, in the manner as depicted). It would not be preferred for the component to be partially supported on a bed of springs, and partially supported or guided on e.g a hinge. In such a case, too large a portion of the shock loads emanating from the component might be transmitted to the circuit board through the hinge. In fact, anything solid, which might transmit shock, needs to be done carefully; given that part of the mounting or guiding has to be solid for location/positioning purposes, it is preferred that that part should be semi-solid, as described. Thus, a set of many springs pushing the component against a small semi-solid latch-ledge is the best; that arrangement gives a good accurate location for the component, and yet gives excellent isolation protection for the circuit board from shocks and impacts emanating from the (heavy) component.

It should be noted that it is the inertia of the camera (or other component) that endangers the circuit board: the mounting-structure itself has little mass, and, if only the mounting-structure itself needed to be considered, it could be attached solidly to the circuit-board. However, as shown, the main-body of the mounting structure should not be attached directly solidly to the circuit board; rather, it is the connector-strips that are solid with respect to the circuit board, and the main-body is clipped to the connector-strips. This extra lack of solidity is an important contributor to the mechanical isolation of the camera from the circuit board.

It will be understood that the plastic material of the main-body itself has a good degree of non-solidity, as a material. Thus, a shock or jolt applied to one point of a plastic body is substantially deadened, i.e is damped and attenuated, as it passes through the plastic body—to a much greater degree than if the body were made of metal.

It would not do for the springs to urge the camera downwards onto the mounting structure, in a way in which the camera bottomed solidly and directly against the soldered joints, since in such a case there would be no shock-absorbing cushion between the heavy camera and the soldered joints. Rather, preferably the springs urge the camera away from the soldered joints.

Preferably, the plastic main-body is not solid with respect to the circuit-board. Rather, it is the connector-strips that are solid with respect to the circuit board, and the plastic main-body floats on the connector-strips. Preferably also, the camera is not solid with respect to the body. The camera is held in place by springs holding the camera against a latch ledge—being an arrangement that is not able to transmit shocks from the camera to the body.

The excellent mechanical isolation of the camera from the circuit-board is the result of a number of factors: the camera floats on springs; plus, the main-body itself is of relatively soft shock-absorbing plastic material; plus, even though the connector-strips are jammed tightly into the attachment-pockets, any impacts and shocks transmitted therethrough will be substantially attenuated; plus, the connector-strips include at least some degree of springiness in the platform-arms 39 between the attachment points 40 and the soldered contact-platforms 38.

The mounting-structure may be used to support components other than cameras. The mounting-structure is most advantageous when used to support dense items, i.e small, heavy components (or large, heavy components). The more springs, the better, so the mounting-structure comes into its own when the component requires a large number of independent connections to the circuit board.

More or less any component that is traditionally connected by a ribbon connector can benefit from the mounting-structure, including such components as screens (including e.g video screens, LCD screens, etc). The mounting-structure is not so ideally suited to e.g batteries, which only require two connectors; although batteries are of course too heavy to be attached solidly to a circuit board, for the same reasons as discussed herein.

If the mounting-structure, though especially suitable when used to mount a multi-conductor component, were used to mount a two-conductor component, such as a battery, or an earpiece or speaker etc, the designer should note that the extra unused or dummy springs would be present only in their capacity as shock absorbers, and not as electrical connectors, so it would not matter if e.g link-bars were left on for those electrically-unused springs.

It should be noted that the contact-platforms are soldered to the contact-pads, as a subsequent operation, after the connector-strips have been assembled into the main-body. Therefore, any slight mismatches or misalignments between the connector-strips and the main-body are accommodated by the solder, so there is no built-in strain at the soldered joints. That is to say, each joint is automatically constrained to take on exactly the shape it needs to be to avoid strain. If the joints were soldered first, and then the strips were attached to the body, inevitably there would be some in-built pre-strain, or pre-stress, locked into the joints. Similarly, it would not do for the camera to be attached directly to the strips, as by being soldered to the strips (even if soldering could be permitted on the grounds that the heat would not damage the camera).

The difficulty of finding room and space on the circuit-board should also be considered. There is a constant desire to add more components and more functions, which means space on the board is at a tight premium. Mounting the camera directly on the circuit-board might seem to be the best solution, in that it avoids the wasted space, as well as the expense, of ribbons. However, the herein-depicted arrangement is better than mounting the camera directly on the circuit-board, because space is created underneath the mounting-structure, i.e in the area of the circuit-board between the contact-pads 50, for the addition of extra components.

The orientation expressions (up, down, etc) as used herein should not be construed in the sense that an apparatus that was covered in one orientation would not be covered in a different orientation. Rather, the orientation expressions are applied when the apparatus is represented on paper, and the paper has been oriented appropriately.

The invention claimed is:

1. A mounting structure for mounting a component to a circuit board, the mounting structure comprising:

a main body comprising:

a main body base:

comprising a main body base upper face, having at least a first side and a second side substantially parallel to each other;

a first retaining arm:

positioned substantially at the of the midpoint of the first parallel side, extending upward from the main body base upper face, resilient about an axis parallel to the first parallel side, and comprising a first latch ledge:

positioned at about the upper end of the first retaining arm, and positioned above and substantially parallel to the main body base upper face; and a second retaining arm:

positioned substantially at the of the midpoint of the second parallel side, extending upward from the main body base upper face, resilient about an axis parallel to the second parallel side, and comprising a second latch ledge:

positioned at about the upper end of the first retaining arm, and positioned above and substantially parallel to the main body base upper face; and a plurality of compression springs:

distributed substantially evenly to each side of an axis passing through and coplanar with both the first latch ledge and the second latch ledge, and oriented in relationship to each latch ledge such that the component installed in the mounting structure is biased toward the first latch ledge and the second latch ledge;

the first latch ledge and the second latch ledge forming a pivot about which the component mounted in the mounting structure can pivot to an extent allowed by the compression of the compression springs.

2. A mounting structure for mounting a component to a circuit board, the mounting structure comprising:

a first latch ledge, a second latch ledge; and a plurality of compression springs:

distributed substantially evenly to each side of an axis passing through and substantially coplanar with both the first latch ledge and the second latch ledge, and oriented in relation to each latch ledge such that the component installed in the mounting structure is biased toward the first latch ledge and the second latch ledge;

the first latch ledge and the second latch ledge forming a pivot about which the component mounted in the mounting structure can pivot to an extent allowed by the compression of the compression springs.

* * * * *